US008297742B2

(12) United States Patent
Von Essen et al.

(10) Patent No.: US 8,297,742 B2
(45) Date of Patent: Oct. 30, 2012

(54) BONDED CIRCUITS AND SEALS IN A PRINTING DEVICE

(75) Inventors: Kevin Von Essen, San Jose, CA (US); John A. Higginson, Santa Clara, CA (US); Andreas Bibl, Los Altos, CA (US)

(73) Assignee: FUJIFILM Corporation, Tokyo (JP)

( * ) Notice: Subject to any disclaimer, the term of this patent is extended or adjusted under 35 U.S.C. 154(b) by 376 days.

(21) Appl. No.: 12/728,020

(22) Filed: Mar. 19, 2010

(65) Prior Publication Data

US 2011/0226807 A1 Sep. 22, 2011

(51) Int. Cl.
*B41J 2/045* (2006.01)

(52) U.S. Cl. ..... 347/68; 347/47

(58) Field of Classification Search ..... None
See application file for complete search history.

(56) References Cited

U.S. PATENT DOCUMENTS

| | | | |
|---|---|---|---|
| 6,164,762 | A | 12/2000 | Sullivan et al. |
| 6,477,901 | B1 | 11/2002 | Tadigadapa et al. |
| 6,527,903 | B1 | 3/2003 | Kataoka et al. |
| 7,536,762 | B2 | 5/2009 | Imai et al. |
| 2004/0113996 | A1 | 6/2004 | Boyd et al. |
| 2006/0187649 | A1 | 8/2006 | Imai et al. |
| 2009/0033721 | A1* | 2/2009 | Silverbrook ..... 347/63 |

FOREIGN PATENT DOCUMENTS

| | | |
|---|---|---|
| EP | 00321075 | 10/1988 |
| EP | 01974921 | 10/2008 |
| JP | 54148533 | 11/1979 |
| WO | WO 2008/051781 A2 | 5/2008 |
| WO | WO 2009/142960 A1 | 11/2009 |
| WO | 2011/005699 | 1/2011 |

OTHER PUBLICATIONS

Extended Search Report issued in corresponding European application No. 11158636.8 dated Aug. 5, 2011, 6 pgs.

"VD™ Solder Layers: old-Tin and Lead Free Alloy Films via JVD™", Jet Process Corporation, [retrieved on Mar. 18, 2010] Retrieved from the Internet: <URL: <http://www.jetprocess.com/html/au_sn_lead_free_solders.htm>, 2 pages.

"Jet Vapor Deposition (JVD) #1 for AuSn Vapor Deposition Wafer Level Packaging", Jet Process Corporation, [retrieved on Mar. 18, 2010] Retrieved from the Internet: <URL: <http://www.jetprocess.com/html/wafer_level_packaging.html>, 3 pages.

(Continued)

*Primary Examiner* — Jerry Rahll
(74) *Attorney, Agent, or Firm* — Fish & Richardson P.C.

(57) ABSTRACT

A fluid ejection device includes a circuit layer having a fluid outlet on a lower surface, a chamber substrate having a fluid inlet on an upper surface, an electrical contact electrically connecting the chamber substrate to the lower surface of the circuit layer, and a seal forming a fluid connection between the fluid outlet of the circuit layer and the fluid inlet of the chamber substrate. The seal and the electrical contact are a eutectic material. The seal and the electrical contact may be the same material.

15 Claims, 7 Drawing Sheets

OTHER PUBLICATIONS

K.J. Huth et al., "Sealing Hermetic Packages Using the Gold-N-Flo™ Process", Semiconductor Packaging Materials (SPM) Co., Armonk, NY 10504, [retrieved on Mar. 19, 2010] Retrieved from the Internet: <URL: http://www.sempck.com/datasheets/spm/GoldNFlo_Extended_Abstract.pdf, 5 pages.

Gerard Minogue et al., "A Novel Approach for Hermetic Wafer Scale MEMS RF and Gas Packaging", Surfect Technologies Inc. and Hinox Inc., [retrieved on Mar. 19, 2010] Retrieved from the Internet: <URL: <http://www.csmantech.org/Digests/2005/2005papers/9.3.pdf>, 3 pages.

N. Belov et al., "Thin-Layer Au-Sn Solder Bonding Process for Wafer-Level Packaging, Electrical Interconnections and Mems Applications", Nanochip, Inc., Intel Corporation, and Micralyne, [retrieved on Mar. 19, 2010] Retrieved from the Internet: <URL: <http://www.micralyne.com/wp-content/uploads/2009/05/thin-layer-au-sn-solder-bonding-process-for-wlp-nanochip-intel-micralyne.pdf>, 3 pages.

* cited by examiner

BONDED CIRCUITS AND SEALS IN A PRINTING DEVICE

TECHNICAL FIELD

The present disclosure relates generally to fluid droplet ejection.

BACKGROUND

In some implementations of a fluid droplet ejection device, a substrate, such as a silicon substrate, includes a fluid pumping chamber, a fill channel, and a nozzle formed therein. Fluid droplets can be ejected from the nozzle onto a medium, such as in a printing operation. The nozzle is fluidly connected to the fluid pumping chamber. The fluid pumping chamber can be actuated by a transducer, such as a thermal or piezoelectric actuator, and when actuated, the fluid pumping chamber can cause ejection of a fluid droplet through the nozzle. The medium can be moved relative to the fluid ejection device. The ejection of a fluid droplet from a nozzle can be timed with the movement of the medium to place a fluid droplet at a desired location on the medium. Fluid ejection devices typically include multiple nozzles, and it is usually desirable to eject fluid droplets of uniform size and speed, and in the same direction, to provide uniform deposition of fluid droplets on the medium.

SUMMARY

In one aspect, a fluid ejection device includes a circuit layer having a fluid outlet on a lower surface, a chamber substrate having a fluid inlet on an upper surface, an electrical contact electrically connecting the chamber substrate to the lower surface of the circuit layer, and a seal forming a fluid connection between the fluid outlet of the circuit layer and the fluid inlet of the chamber substrate. The seal and the electrical contact are a eutectic material.

Implementations may include one or more of the following features. The seal may surround the fluid inlet. An actuator may be located on the upper surface of the chamber substrate, and the electrical contact may be in electrical communication with the actuator. A stand-off bump may be located on the lower surface of the circuit layer, and may contact the actuator. The actuator may include a piezoelectric material having a non-actuatable portion, and the stand-off bump may contact the non-actuatable portion. The actuator may be lead zirconium titanate, the stand-off bump may be gold and the eutectic material may be SnAu. The eutectic material may be formed of a first material and a second material, and the stand-off bump may be formed of the first material but not the second material. The eutectic material may be SnAu, e.g., 20:80 SnAu. The circuit layer may include a plurality of fluid outlets, the chamber substrate may includes a plurality of fluid inlets, and a perimeter seal around the plurality of fluid outlets and fluid inlets may hermetically seal a space between the circuit layer and the chamber substrate from an environment outside of the device. The seal and the electrical contact may be the same material.

In another aspect, a method of forming a fluid ejection device includes forming a contact bump and a seal bump of a first material on a lower surface of a circuit layer, wherein the circuit layer has a fluid outlet on the lower surface, forming a contact bump of a second material and a seal bump of the second material on an upper surface of a chamber substrate, wherein the chamber substrate has a fluid inlet formed in the upper surface, bringing together the contact bump of the first material on the lower surface of the circuit layer and the contact bump of the second material on the upper surface of the chamber substrate, bringing together the seal bump of the first material on the lower surface of the circuit layer and the seal bump of the second material on the upper surface of the chamber substrate, heating the contact bump on the chamber substrate to form a eutectic bond between the contact bump on the lower surface of the circuit layer and the contact bump of the upper surface of the chamber substrate to form an electrical contact, and heating the seal bump on the chamber substrate to form a eutectic bond between the seal bump on the lower surface of the circuit layer and the seal bump of the upper surface of the chamber substrate to form a seal.

Implementations may include one or more of the following features. At least one of the seal bump of the first material or the seal bump of the second bump may have a ring shape. The ring shape may include two concentric rings. The seal may surround the fluid inlet. An actuator may be formed on the upper surface of the chamber substrate, and the electrical contact may be electrically connected with the actuator. A stand-off bump may be formed on the lower surface of the circuit layer, and the stand-off bump may be brought into contact with the actuator. Bringing the stand-off bump into contact with the actuator may include bringing the stand-off bump into contact with a non-actuatable portion of a piezoelectric material of the actuator. The piezoelectric material may be lead zirconium titanate, the stand-off bump may be gold, and the eutectic material may be SnAu. The actuator may include a layer of piezoelectric material, and heating the contact bump and heating the seal bump may be performed below a Curie temperature of the piezoelectric material. Forming a eutectic bond between the seal bump on the lower surface of the circuit layer and the seal bump of the upper surface of the chamber substrate may result in a stand-off distance between the seal bump on the upper surface of the chamber substrate and the actuator. The eutectic bond may be formed of a first material and a second material, and the stand-off bump may be formed of the first material but not the second material. The eutectic bond may be SnAu, e.g., 20:80 SnAu. The seal and the electrical contact may be the same material. At least one of the contact bump and the seal bump of the first material, or the contact bump and the seal bump of the second material, may be chemical mechanical polished.

In another aspect, a fluid ejection device includes a fluid feed substrate having a fluid outlet on a lower surface, a chamber substrate having a fluid inlet on an upper surface, a seal forming a fluid connection between the fluid outlet of the fluid feed substrate and the fluid inlet of the chamber substrate, wherein the seal is a eutectic material formed of a first material and a second material, and a stand-off bump between the fluid feed substrate and the chamber substrate, wherein the stand-off bump includes the first material, but does not include the second material.

Implementations may include one or more of the following features. The stand-off bump may contacts a surface of the fluid feed substrate that faces the chamber substrate. The stand-off bump may contacts a surface of the fluid feed substrate in an aperture of a layer including the second material that is on the fluid feed substrate, a portion of the layer forming the seal. The stand-off bump may be between a portion of piezoelectric material and the fluid feed substrate. Implementations of the device may include one or more of the following advantages. Forming electrical bonds and seals between two layers that are of the same material can simplify manufacturing. When the material is a metal, the metal can have a low thermal coefficient of expansion and therefore consistently bond together two layers without expanding. A metal material can be polished, which can improve uniformity compared with other bonding materials that are difficult to uniformly apply over an area. Because the electrical bonds and seals are made of the same materials, all connections can be made at the same temperature. A non-corrosive material can be selected to form the electrical bonds and seals, which can reduce the likelihood of corrosion. Reducing corrosion can increase device lifetime. If one of the materials used to form one part of the seals and electrical connections has a higher melting temperature than the bonding temperature, a stand-off bump can be formed from that material. The stand-off bump can be used to ensure uniform spacing between the two layers being bonded together. Uniformity between two layers that make up a fluid droplet ejection device with multiple jetting structures can enable the multiple jetting structures to have uniform characteristics. The seals and electrical contacts can be the same material as one another, which means that they have matched thermal coefficients of expansion, which can make the bonds more robust to thermal stress. A perimeter seal between the two layers can allow for protecting the electrical components between the two layers from moisture. Protecting the electrical components from moisture can increase device lifetime. The perimeter seal can be the same material as the electrical contacts and seals to further simplify manufacturing.

The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

In some multi-layer printing devices in which a printing fluid, such as ink, flows through a layer in which integrated circuits are fabricated and into a layer that includes a pumping chamber, the integrated circuit layer and pumping chamber substrate are bonded together. The bonding connects fluid outlets in the integrated circuit layer to fluid inlets in the pumping chamber substrate. In addition, some electrical components on the pumping chamber substrate, such as transducers or actuators on the pumping chamber substrate, are electrically connected to the integrated circuit layer. One potential problem is that bonding the integrated circuit layer and pumping chamber substrate in a manner that fluid does not leak between the two layers and cause shorts in electrical components can be complex and expensive. To simplify processing, the bonding between the two layers can be of the same material, regardless of whether the bonding is for making electrical connections or for making fluid seals. For printing devices where the transducer is formed of a poled material, such as a piezoelectric material, for example, lead zirconium titanate ("PZT"), the bonding temperature of the bonding material can be below the Curie temperature of the poled material to prevent depoling of the material. Some types of eutectic bonding materials make desirable bonding materials.

Figure 1:
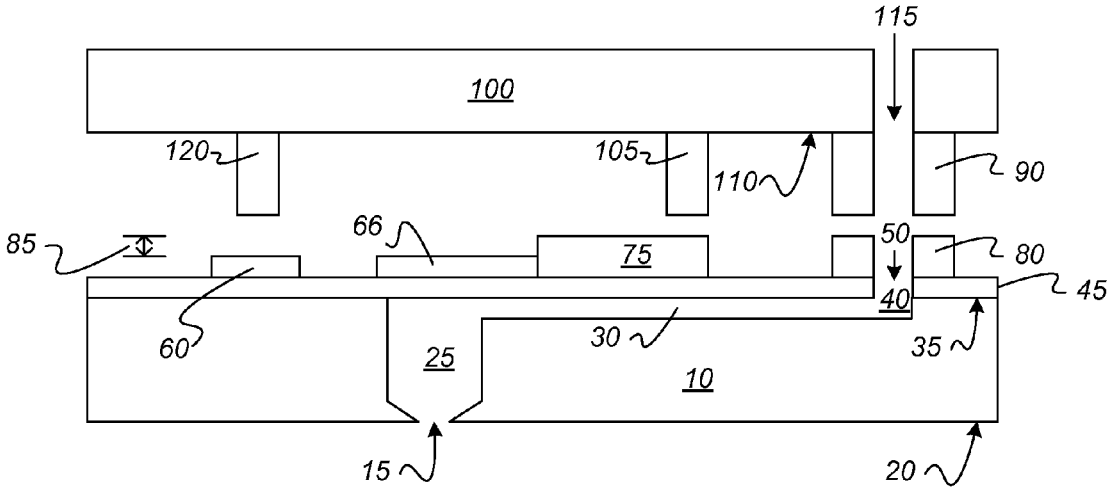
FIG. 1 is a cross-sectional side view of the integrated circuit layer and the pumping chamber substrate prior to being bonded together.

Referring to FIG. 1, a single jetting structure of a device having multiple jetting structures is shown. A substrate 10, or pumping chamber substrate, includes a nozzle 15 for ejecting fluid at a lower surface 20 of the substrate 10. A pumping chamber 25 is in fluid communication with the nozzle 15. The pumping chamber 25 is also in fluid communication with a fill channel 30 located near an upper surface 35 of the substrate 10. The fill channel 30 is in fluid communication with an inlet 40 in the upper surface 35. Optionally, a membrane layer 45 covers the pumping chamber 25 and fill channel 30. The membrane layer 45 has an aperture 50 that is adjacent to and in fluid communication with the inlet 40 of substrate 10.

A non-active portion of piezoelectric material 60 and an active portion of piezoelectric material 66 that forms a piezoelectric actuator are on a top surface 35 of the substrate 10. The active portion of piezoelectric material 66 is located in a region above the pumping chamber 25 so that actuation of the piezoelectric actuator causes expansion or contraction of the pumping chamber 25, thereby filling the pumping chamber 25 with fluid from the fill channel 30 or expelling fluid out of the nozzle 15. The piezoelectric actuator includes the active portion of a layer of piezoelectric material sandwiched between an upper conductive layer and a lower conductive layer. An electrical connector structure, which can include a conductive trace 75 formed on the top surface of the substrate 10, e.g., on the membrane layer 45 or on a piezoelectric layer on the membrane layer, carries electrical signals from a drive source, e.g., an integrated circuit in the integrated circuit layer 100, to the piezoelectric actuator. The trace 75 can be formed from the same conductive layer as the upper or lower conductive layer of the piezoelectric actuator, or can be a separately fabricated layer. In some implementations, the electrical connector structure includes multiple layers, such as a seed layer as well as the structural layers. Seed layers can be formed of materials, such as titanium-tungsten (TiW) and gold (Au) or titanium-platinum (TiPt) and gold. The TiW or TiPt layer can have a thickness of between 50 and 200 nm, such as about 100 nm. The Au layer can be between 100 and 300 nm, such as about 200 nm. These layers can be applied, such as by vapor deposition, e.g., sputtering. A structural layer, such as a gold-tin layer, can be plated or vapor deposited on top of the seed layer. The structural layer can have a thickness between 2 and 20 microns.

The trace 75 ends in a contact pad. Although a single electrical connector is shown, in some implementations, each piezoelectric actuator has a pair of traces, for example, for a dual electrode configuration that includes an inner electrode and outer electrode. In some implementations, the piezoelectric actuator has a thickness less than a thickness of the conductive trace 75 such that there is a height difference 85 between a top surface of the piezoelectric actuator and the top surface of the conductive trace 75.

The top surface 35 of the substrate 10 also has a lower seal portion 80 or seal bump. A corresponding upper seal portion 90 is formed on a lower surface of the integrated circuit layer 100, or ASIC layer. The upper seal portion 90 is around a fluid outlet 115 in the integrated circuit layer 100. In addition to forming the upper seal portion 90 on the integrated circuit layer 100, a conductive electrical contact bump 105 is formed on the lower surface 110 of the integrated circuit layer 100. The electrical contact bump 105 is in electrical communication with circuitry, e.g., integrated circuits, within the integrated circuit layer 100. Optionally, a stand-off bump 120 is also formed on the lower surface 110 of the integrated circuit layer 100.

In some implementations, the conductive materials on the upper surface 35 of the substrate 10 that will come into direct contact with conductive materials on the integrated circuit layer 100, that is, the conductive trace 75 and lower seal portion 80, or lower seal bump, are the same material as one another. In some implementations, the conductive materials on the lower surface 110 of the integrated circuit layer 100 that will come into direct contact with conductive materials on the upper surface 35 of the substrate 10, that is, the electrical bump 105 and upper seal portion 90 plus the stand-off bump 120 (which does not contact a conductive material on the substrate 10), are the same material as one another. In some implementations, the conductive materials on the lower surface 110 of the integrated circuit layer 100 have a different composition from the conductive materials on the upper surface 35 of the substrate 10. In some implementations, the conductive materials are metal.

The materials on the upper surface 35 of the substrate 10 can form a eutectic bond with the materials on the lower surface 110 of the integrated circuit layer 100. Many materials can form eutectic bonds and may be selected for the conductive materials on the upper surface 35 and the conductive materials on the lower surface 110. The conductive materials on the upper surface 35 can be gold, such as 100% gold, and the conductive materials on the lower surface 110 can be tin or a tin-gold blend, such as a blend with greater amounts of gold than tin, for example a 80:20 gold-tin blend. Other blends can include gold and silicon, tin and copper, tin and silver and indium and gold. When the integrated circuit layer 100 is brought into contact with the substrate 10 so that the lower seal portion 80 contacts the upper seal portion 90 and the electrical bump 105 contacts the conductive trace 75, such as the contact pad of the trace 75, one material, such as the tin, can migrate into the other, such as the gold, to form the bond. Other suitable materials for forming the seals and bonds can be materials that do not form eutectic bonds, such as copper and gold-plated copper. Because the bond forms seals through which fluid flows, materials that are non-corroding can provide longer device lifetime than materials that are susceptible to corrosion.

The conductive materials may need to be heated to form the bond. Gold and tin-gold can form a eutectic bond at a bonding temperature of about 280° and 300° C. Because this temperature is below the Curie temperature of sputtered PZT, which is about 300° C., a tin-gold eutectic bond can be used with sputtered PZT without the danger of depoling the PZT. The tin-gold eutectic bond will not reflow unless heated to a higher temperature, such as around 380° C. Thus, if additional heating steps are required in manufacturing the device, so long as the heating steps are below the eutectic bond reflow temperature, the device can be heated without destroying or damaging any of the bonds or seals. The Curie temperature of bulk PZT can be around 200° C. and other bonding materials with lower bonding temperatures may be used with bulk PZT to prevent depoling.

Figure 2:
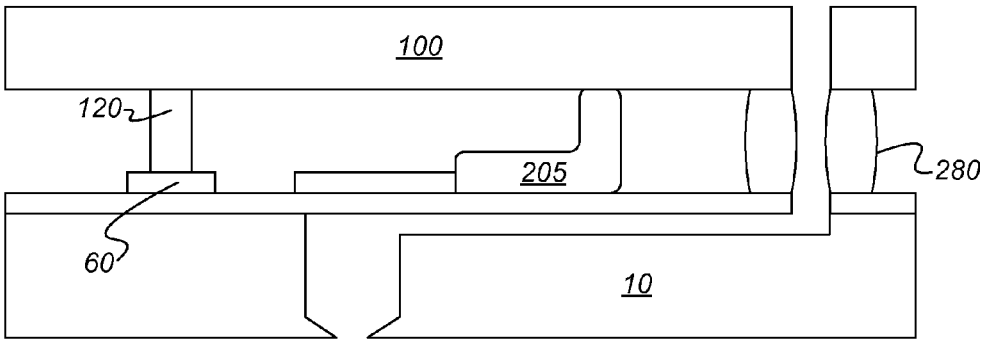
FIG. 2 is a cross-sectional side view of the integrated circuit layer and the pumping chamber substrate after to being bonded together.

Referring to FIG. 2, a bonded assembly is shown after the substrate and integrated circuit layer are brought together. The conductive layers after bonding have formed an electrical contact 205 and seal 280 due to either the pressure or heat applied to the conductive layers. The seal has an aperture through it for flow of liquid from outlet to inlet. In some implementations, the seal is annular. The heating and bonding can occur while the substrate and integrated circuit layer are pushed together or crushed together to ensure a good bond. It is desirable to have a consistent spacing between the substrate and integrated circuit across many jetting structures. Also, it is desirable to ensure that the material that forms the seals does not compress so much that it restricts the fluid outlet 115 in the integrated circuit layer 100 or the inlet 40 in the substrate 10. The stand-off bump 120 can provide a spacer between the integrated circuit layer 100 and the substrate 10. In some implementations, the spacer bump material is a material that has a higher melting point than the bonding temperature of the seals and electrical bumps. Because the spacer bump does not melt at the bonding temperature, the spacer bump does not deform when the assembly is bonded. Thus, a plurality of spacer bumps can maintain a consistent and uniform spacing across an assembly including a plurality of jetting structures.

In some implementations, the stand-off bump 120 is placed so that it contacts a non-active portion of piezoelectric material 60. The stand-off bump 120 can contact the piezoelectric material itself, rather than conductive material. If the stand-off bump 120 contacts a non-active portion 60 of the piezoelectric material, the stand-off bump 120 does not interfere with the active portion of the piezoelectric material 66 and thus does not interfere with jetting. The height difference 85 (see FIG. 1) between the thickness of the piezoelectric actuators and the lower conductive trace 75 determines how much deformation or change in height is between the thickness of the seal or electrical bump and the conductive layers that form the seals and electrical bump.

Figure 3:
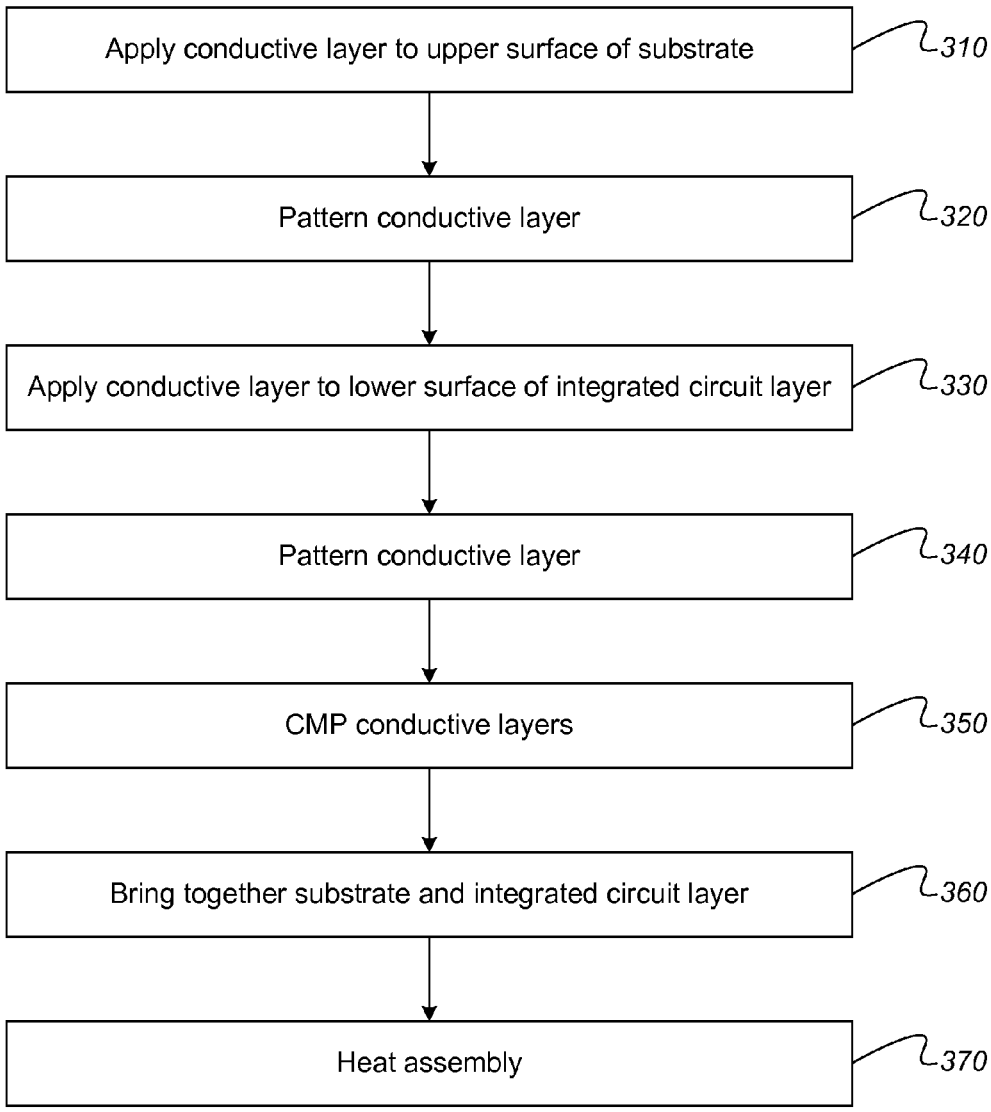
FIG. 3 is a flow diagram for forming the device.

Referring to FIG. 3, the method of forming the assembly is described. The steps are shown in a particular order, but many of the steps can be rearranged or performed in a different order. A conductive layer is applied to the upper surface of the substrate (step 310). In some implementations, the conductive layer is formed by sputtering, plating, vapor deposition, or a combination of these methods. At this point, the substrate can have features, such as the pumping chamber, nozzle and fill channel formed therein. If there is a membrane on the substrate, the conductive layer is formed on the membrane. If the substrate and membrane are formed of silicon, the features can be formed and membrane can be applied using semiconducting process techniques. The substrate also has at least the piezoelectric material of the piezoelectric actuator formed thereon prior to forming the conductive layer. The conductive layer can be anywhere between 2 and 20 microns thick, such as about 10 microns thick. In some implementations, the thickness of the conductive layer is greater than the thickness of the piezoelectric material to ensure that when the upper and lower bumps are brought together and there is a stand-off bump that contact is made between all the bumps on the substrate and the corresponding bumps on the integrated circuit layer. The conductive layer is then patterned (step 320). In some implementations, steps 310 and 320 are combined by forming the conductive layer through a mask so that a separate patterning step is not required.

A conductive layer is then formed on the lower surface of the integrated circuit layer (step 330). In some implementations, the conductive layer is formed by sputtering, plating, vapor deposition, or a combination of these methods. The conductive layer is then patterned (step 340). As with the conductive layer on the substrate, steps 330 and 340 can be combined by using a mask to apply the conductive layer. The conductive layer can be anywhere between 1 and 20 microns thick, such as about five microns thick. In some implementations, the conductive layer on the lower surface of the integrated circuit layer is thicker than the conductive layer formed on the upper surface of the substrate. If the piezoelectric layer is three microns thick and the conductive layer on the substrate is five microns thick, the stand-off distance or deformation distance is two microns. Thus, the final seal and electrical contact thickness can be the thickness of the two conductive layers minus the stand-off distance.

Optionally, one or both of the conductive layers are polished, such as by chemical mechanical polishing (step 350). A polishing step can ensure that the bumps of the conductive layer have a uniform height or have a smooth surface for bonding. The substrate and the integrated circuit layer are brought together so that the electrical bumps on the two surfaces contact one another and the seal portions on the two surfaces contact one another. The assembly is then heated (step 360). Optionally, only the substrate or the integrated circuit layer is heated before the assembly is brought together. And optionally, once the assembly is brought together pressure is placed on one or both of the substrate or the integrated circuit layer to crush the bumps and seal portions together.

In some implementations, in addition to forming the seals and the electrical connections, a perimeter seal can be formed with a portion of the conductive layer and around the top surface of the substrate and the bottom surface of the integrated circuit layer. The perimeter seal is formed of the same conductive layers as form the seals and electrical connections. The perimeter seal can hermetically seal the space between the substrate and the integrated circuit layer. This can prevent moisture from entering between the two layers and shortening the life of the electrical components. Space between the two layers can further be filled with an inert gas, such as nitrogen or helium to further protect the electrical components from corrosion.

Figure 4:
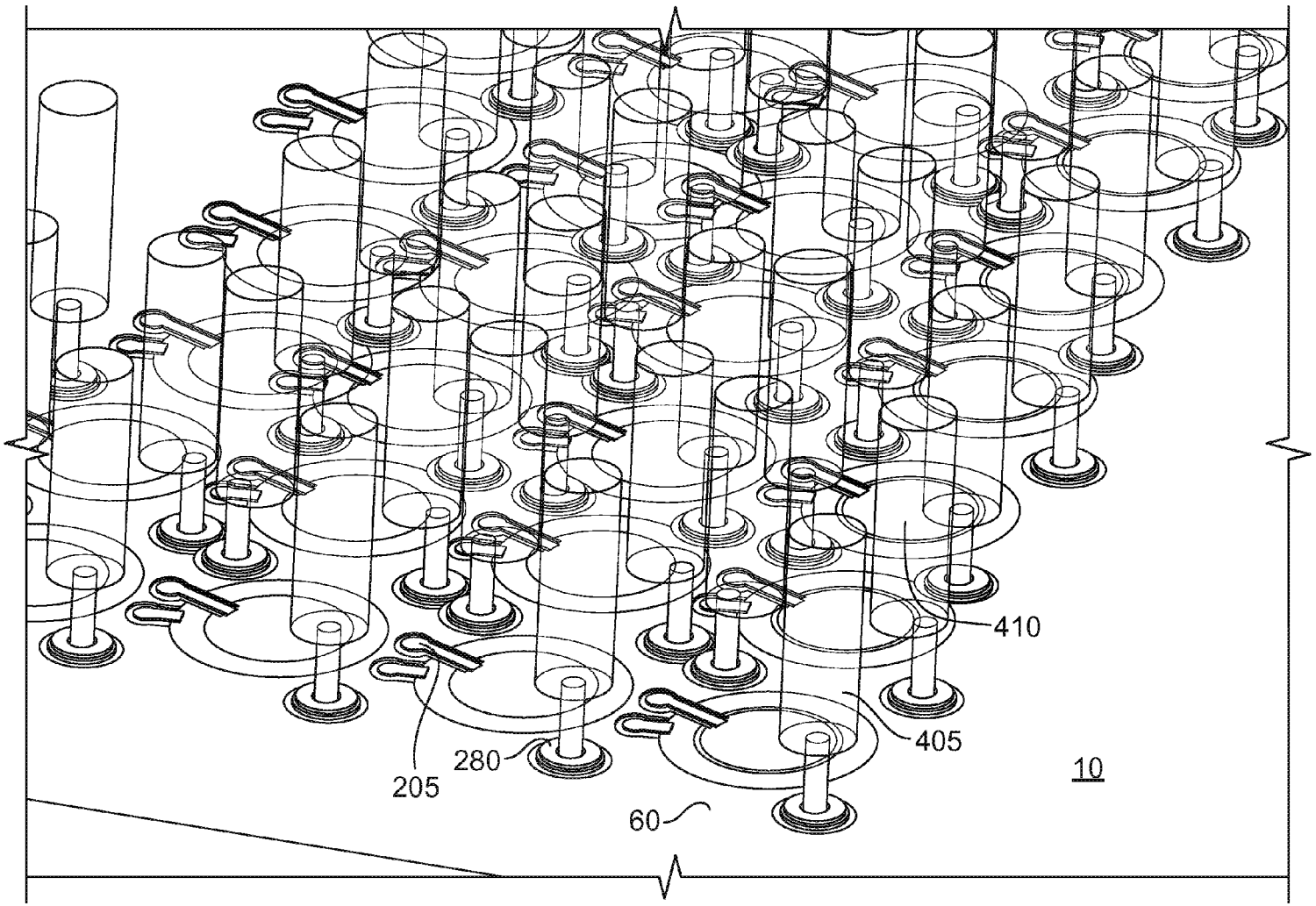
FIG. 4 is a partial perspective view of a print head module where an integrated circuit layer is bonded to a pumping chamber substrate and the integrated circuit layer is shown as transparent.

Referring to FIG. 4, an implementation of the device is shown where each pumping chamber has a fluid inlet and a fluid outlet. Multiple jetting structures are shown. The integrated circuit layer is shown as transparent in the figure and only the ascenders 405, which are connected to the fluid inlets, and the descenders 410, which are connected to the fluid outlets, can be seen rather than the integrated circuit material.

Figure 5:
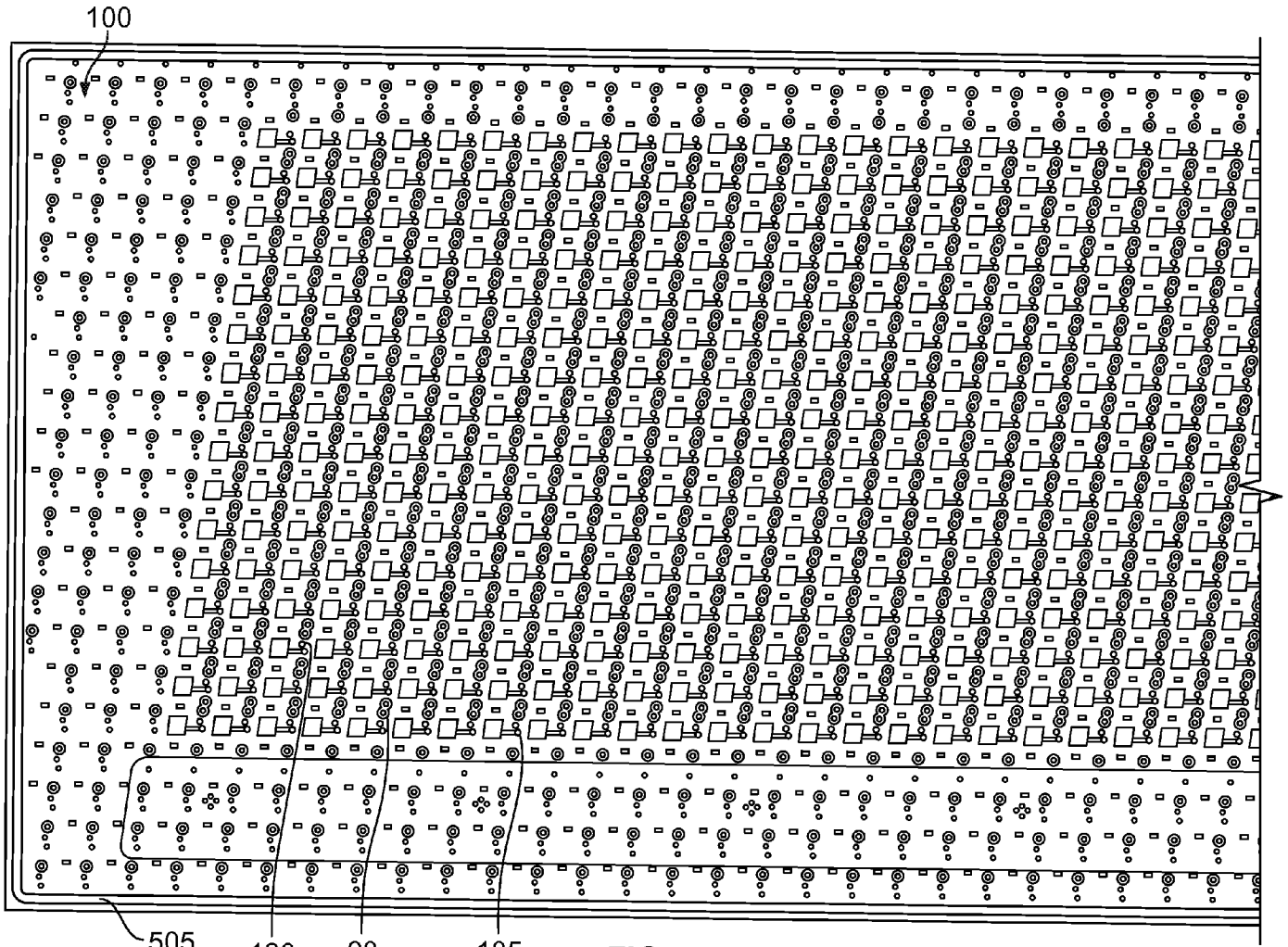
FIG. 5 is a view of a bottom surface of the integrated circuit layer.

Referring to FIG. 5, a bottom view of the integrated circuit layer 100 shows electrical bumps 105, fluid connection portions 90 and the stand-off bumps 120, along with the perimeter seal 505. FIG. 5 also shows the upper conductive layers for the piezoelectric actuators in order to illustrate its position relative to the other elements, although the upper conductive layer is on the pumping chamber substrate rather than the integrated circuit layer.

Figure 6:
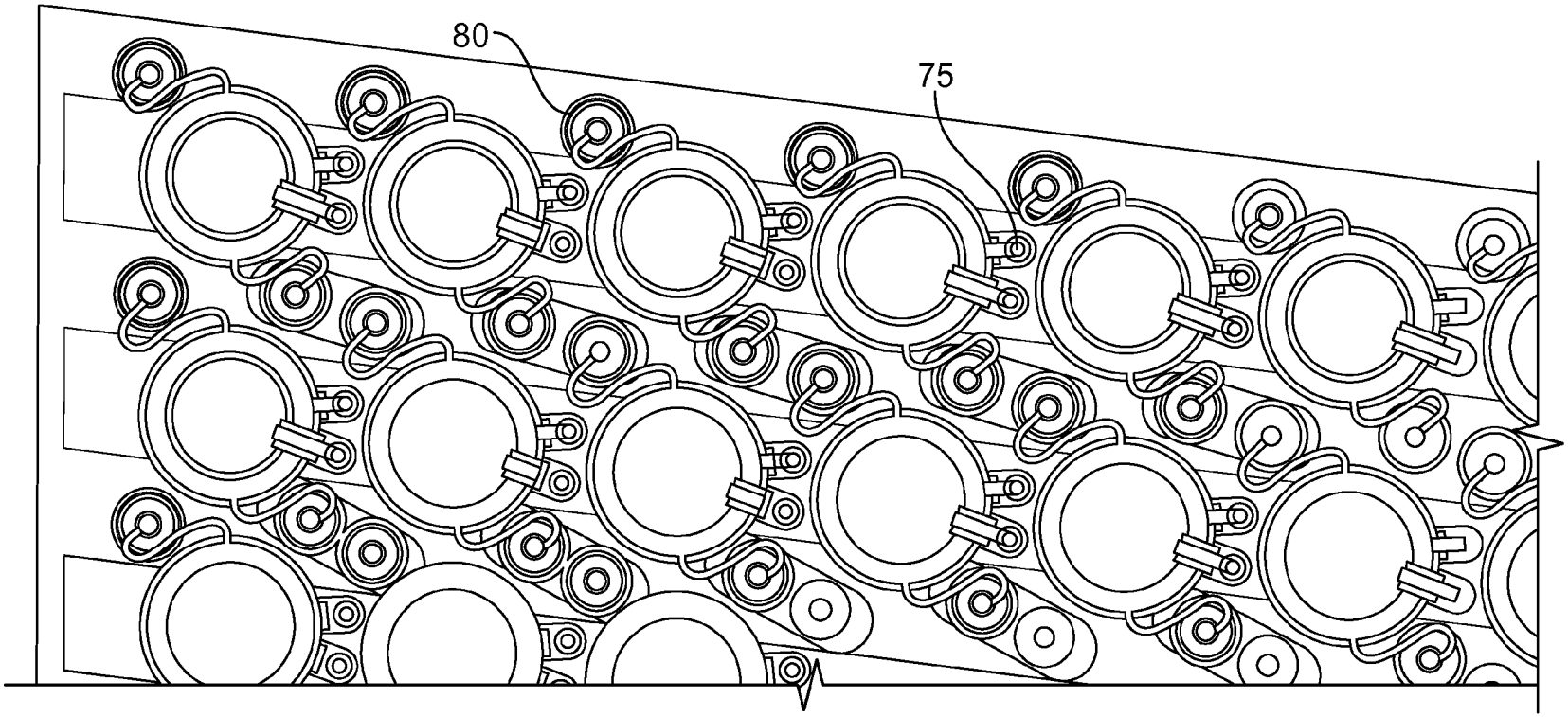
FIG. 6 is a partial plan view of a top surface of a pumping chamber substrate.

Referring to FIG. 6, a partial top view of the substrate layer shows the electrical bumps or conductive trace 75 and fluid seal portions 80.

Figure 7:
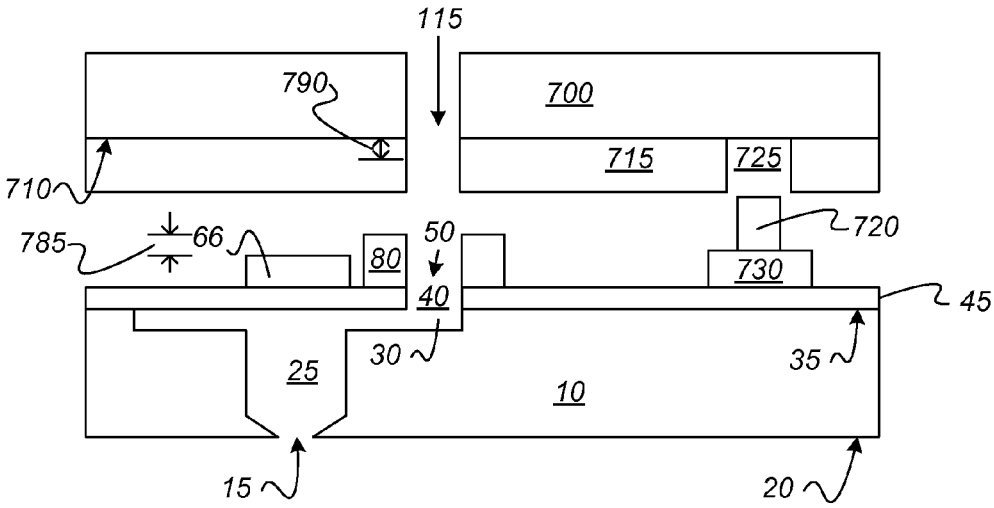
FIG. 7 is a cross-sectional side view of a fluid inlet layer and a pumping chamber substrate prior to being bonded together.

Referring to FIG. 7, in some implementations, the integrated circuit layer 100 is replaced by a fluid feed substrate 700. The fluid feed substrate includes the fluid outlet 115, but does not include any or all of the circuitry that the integrated circuit layer 100 includes. A layer 715 of material capable of forming a eutectic layer is formed on a bottom surface 710 of the fluid feed substrate 700, such as a layer of Au:Sn, Au or Sn. An aperture 725 is formed in the layer 715. The aperture 725 is formed in a layer that is not directly over the pumping chamber in the substrate 10 when the substrate 10 and fluid feed substrate 700 are brought together. The aperture 725 can be formed, such as by etching, the layer 715 after applying a uniform layer 715 to an entirety of the fluid feed substrate 700. The fluid outlet 115 can be formed in the fluid feed substrate 700 either before or after forming the uniform layer 715.

The substrate 10 and its features are similar to the substrate described above. However, a stand-off bump 720 is formed on a section of material, such as inactive piezoelectric material 730. In some implementations, the stand-off bump 720 has the same thickness as a thickness of the lower seal 80. A difference 785 between a thickness of the active portion of the piezoelectric material 66 and the lower seal thickness 80 determines a gap between the layer 715 and an upper surface of active portion of the piezoelectric material 66 when the fluid feed substrate 700 is brought together with the substrate 10 before eutectic bonding occurs. The difference between the depth of the aperture 725 and the thickness of the stand-off bump 720 determines a gap 790 between the upper surface of the stand-off bump 720 and the lower surface 710 of the fluid feed substrate 700 when the fluid feed substrate 700 is brought together with the substrate 10 and before eutectic bonding occurs. The gap 790 determines the amount of flowing that can occur between the lower seal material 80 and the layer 715 material when the eutectic bond is made. After eutectic bonding, the gap 795 between the layer 715 and an upper surface of the active portion of the piezoelectric material 66 equals the difference between the difference 785 and gap 790.

In some implementations, the stand-off bump 720 is thicker than the layer 715, e.g., by 2 microns. In some implementations, the layer 715 has a height between 5 and 7 microns, e.g., 5 microns, and the stand-off bump 720 and seal 80 have a height of between 7 and 9 microns, such as of 7 microns. In some implementations, the piezoelectric layer, e.g., the active portion of the piezoelectric material 66 and the inactive piezoelectric material 730, has a thickness of 3 microns. Thus, the difference 785 between the piezoelectric material 66 and the seal 80 is 4 microns and the gap 790 between the lower surface 710 of the fluid feed substrate 700 in aperture 725 and the top of the stand-off bump 720 is 2 microns. After eutectic bonding, the gap between the layer 715 and the upper surface of the active portion of the piezoelectric material 66 is the difference between 4 microns and 2 microns, i.e. 2 microns.

Figure 8:
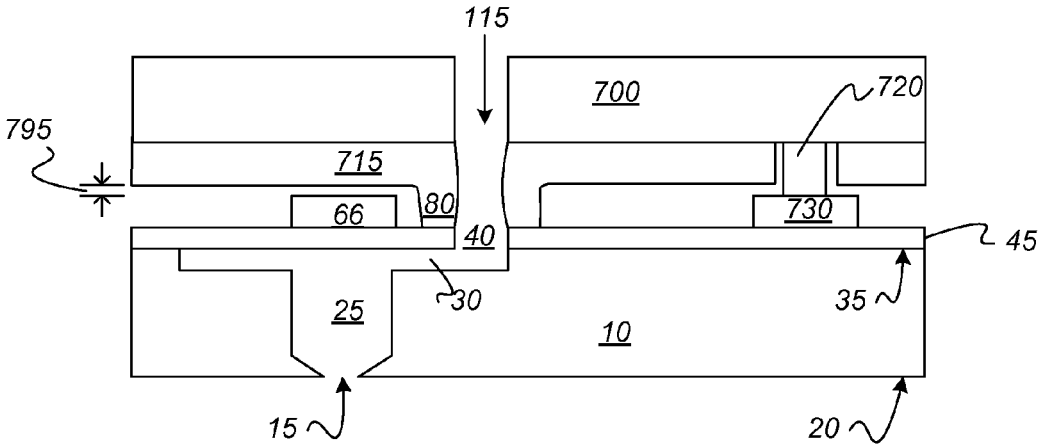
FIGS. 8 and 9 show an alternative configuration for seals in any of the implementations.

At least one of the layer 715 and the lower seal 80 are heated to form the eutectic bond between the substrate 10 and the fluid feed substrate 700, as shown in FIG. 8. The eutectic bond can be any of the materials described herein. For example, if the eutectic bond is a gold:tin bond, layer 715 formed on the fluid feed substrate 700 can be formed of a gold:tin material or tin. In this case, the lower seal 80 and stand-off bump are formed of gold. Alternatively, the layer 715 can be formed of gold and the lower seal 80 and stand-off bump are formed of a gold:tin material or tin. The stand-off bumps 720 should be sufficiently tall so that after eutectic bonding there is a clearance, e.g., at least a 2 micron clearance, between the top of the active piezoelectric material 66 and the eutectic layer 715.

Figure 9:
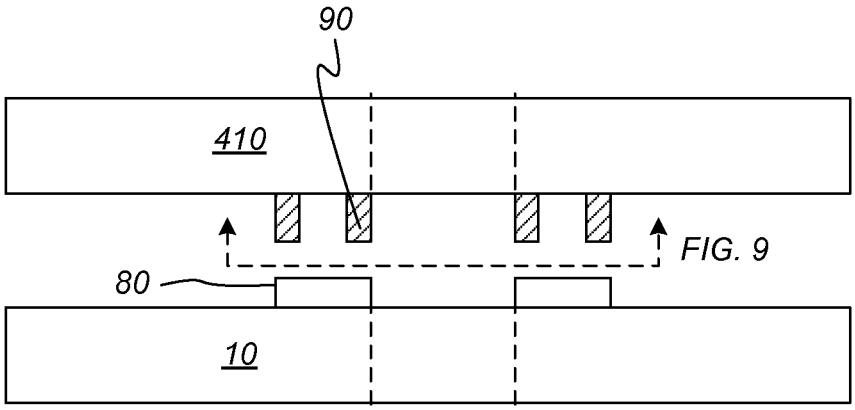
Figure 10:
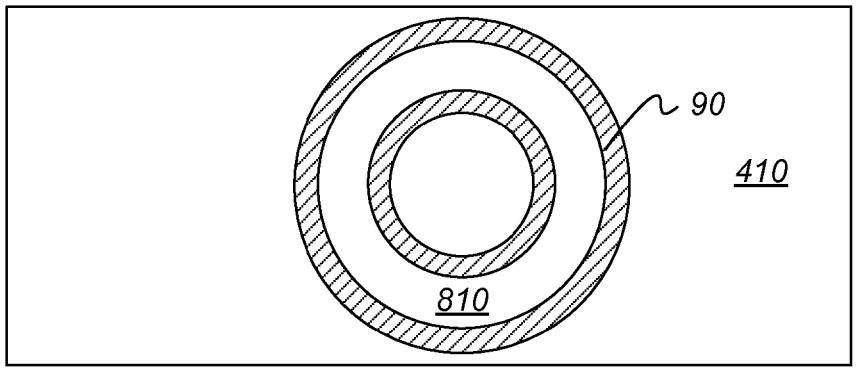
FIGS. 10 and 11 show top and bottom views of the integrated circuit layer and the pumping chamber substrate, respectively.
Figure 11:
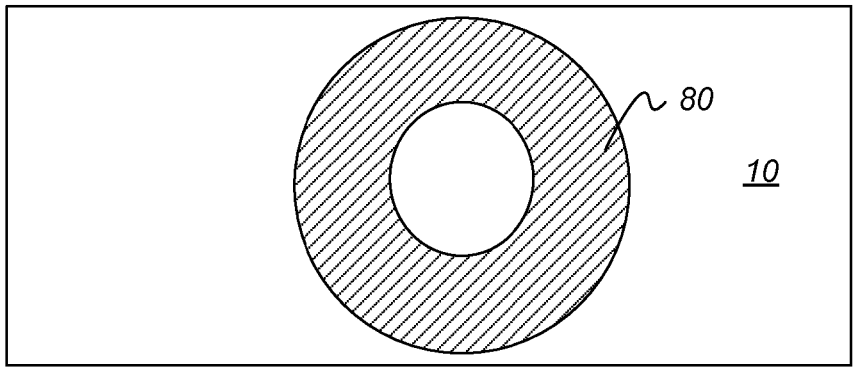

Referring to FIGS. 9-11, an alternative implementation of the fluid seal is shown. The seal surrounds the fluid inlet and outlet and therefore is ring or donut shaped, although it could be some other geometry, such as square, oval, rectangular or another shape so long as it surrounds the outer diameter of the fluid inlet or outlet. In addition, one side of the seal can be configured as two or more concentric rings. This provides a space 810 between the two rings for material to flow into. Providing a space for material flow can prevent the material from flowing uncontrolled into regions where it is not desired, such as into the inlet or outlet of the fluid channel or where it can contact electrical connections.

Eutecticly bonding the integrated circuit layer and pumping chamber substrate with respect to a single printing device has been described. In some implementations, a first wafer (e.g. silicon wafer) including a plurality of integrated circuit layers can be aligned and eutecticly bonded to a second wafer including a plurality of pumping chamber substrates to form a plurality of printing devices. Eutectic bonding enables a plurality of printing devices to be made simultaneously at the wafer level rather than at the die level. For example, at the die level, a plurality of integrated circuit layers are singulated from a first wafer, a plurality of pumping chamber substrates are singulated from a second wafer, and then the two layers are individually bonded together. Bonding at the wafer level can increase production and minimize damage to individual layers during handling.

A number of implementations have been described. Nevertheless, it will be understood that various modifications may be made without departing from the spirit and scope of the invention. For example, in some implementations, there is no electrical connection to the fluid seals. In other implementations, the fluid seals are grounded. Any of the features described herein can be used with any of the implementations described herein. The features are not meant to be limited to the implementation with which they are described. Accordingly, other embodiments are within the scope of the following claims.

What is claimed is:

1. A fluid ejection device, comprising:

a circuit layer having a fluid outlet on a lower surface;

a chamber substrate having a fluid inlet on an upper surface;

an electrical contact electrically connecting the chamber substrate to the lower surface of the circuit layer; and a seal forming a fluid connection between the fluid outlet of the circuit layer and the fluid inlet of the chamber substrate, wherein the seal and the electrical contact are a eutectic material.

2. The fluid ejection device of claim 1, wherein the seal surrounds the fluid inlet.

3. The fluid ejection device of claim 1, further comprising an actuator on the upper surface of the chamber substrate, wherein the electrical contact is in electrical communication with the actuator.

4. The fluid ejection device of claim 3, further comprising a stand-off bump on the lower surface of the circuit layer, wherein the stand-off bump contacts the actuator.

5. The fluid ejection device of claim 4, wherein the actuator includes a piezoelectric material having a non-actuatable portion and the stand-off bump contacts the non-actuatable portion.

6. The fluid ejection device of claim 5, wherein the actuator is formed of lead zirconium titanate, the stand-off bump is formed of gold and the eutectic material is SnAu.

7. The fluid ejection device of claim 1, wherein the eutectic material is formed of a first material and a second material and the stand-off bump is formed of the first material, but not the second material.

8. The fluid ejection device of claim 1, wherein the eutectic material is SnAu.

9. The fluid ejection device of claim 8, wherein the eutectic material is 20:80 SnAu.

10. The fluid ejection device of claim 1, wherein the circuit layer includes a plurality of fluid outlets, the chamber substrate includes a plurality of fluid inlets and a perimeter seal around the plurality of fluid outlets and fluid inlets hermetically sealing a space between the circuit layer and the chamber substrate from an environment outside of the device.

11. The fluid ejection device of claim 1, wherein the seal and the electrical contact are formed of the same material.

12. A fluid ejection device, comprising:

a fluid feed substrate having a fluid outlet on a lower surface;

a chamber substrate having a fluid inlet on an upper surface;

a seal forming a fluid connection between the fluid outlet of the fluid feed substrate and the fluid inlet of the chamber substrate, wherein the seal is a eutectic material formed of a first material and a second material;

a stand-off bump between the fluid feed substrate and the chamber substrate, wherein the stand-off bump includes the first material, but does not include the second material.

13. The fluid ejection device of claim 12, wherein the stand-off bump contacts a surface of the fluid feed substrate that faces the chamber substrate.

14. The fluid ejection device of claim 13, wherein the stand-off bump contacts a surface of the fluid feed substrate in an aperture of a layer including the second material that is on the fluid feed substrate, a portion of the layer forming the seal.

15. The fluid ejection device of claim 12, wherein the stand-off bump is between a portion of piezoelectric material and the fluid feed substrate.

* * * * *